US009850012B2

(12) United States Patent
Blanz et al.

(10) Patent No.: US 9,850,012 B2
(45) Date of Patent: Dec. 26, 2017

(54) PRODUCT STACKING DEVICE

(71) Applicant: Robert Bosch GmbH, Stuttgart (DE)

(72) Inventors: Peter Blanz, Neuhausen (CH); Alfred Wipf, Jestetten (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/414,346

(22) PCT Filed: Jul. 16, 2013

(86) PCT No.: PCT/EP2013/064965
§ 371 (c)(1),
(2) Date: Jan. 12, 2015

(87) PCT Pub. No.: WO2014/012913
PCT Pub. Date: Jan. 23, 2014

(65) Prior Publication Data

US 2015/0217886 A1 Aug. 6, 2015

(30) Foreign Application Priority Data

Jul. 20, 2012 (DE) ..... 10 2012 212 825

(51) Int. Cl.
*B65G 47/26* (2006.01)
*B65B 35/44* (2006.01)
(Continued)

(52) U.S. Cl.
CPC ..... *B65B 35/44* (2013.01); *B65B 23/14* (2013.01); *B65B 35/50* (2013.01);
(Continued)

(58) Field of Classification Search
CPC ... B65B 35/445; B65B 23/14; B65B 29/6618; B65B 31/309; B65B 57/32; B65B 47/26; B65B 47/841
(Continued)

(56) References Cited

U.S. PATENT DOCUMENTS 2,708,863 A 5/1955 Payne
3,662,875 A * 5/1972 Salomon ..... B65G 47/082 198/419.3
(Continued)

FOREIGN PATENT DOCUMENTS

CN 1877885 A 12/2006
CN 101168415 A 4/2008
(Continued)

OTHER PUBLICATIONS

International Search Report for Application No. PCT/EP2013/064965 dated Oct. 8, 2013 (English Translation, 2 pages).

*Primary Examiner* — William R Harp
(74) *Attorney, Agent, or Firm* — Michael Best & Friedrich LLP

(57) ABSTRACT

The invention relates to a product stacking device for forming product stacks (12 *a-k*) of product groups (14 *a-k*) consisting of products (16 *a-k*), which lie flatly and/or are brought into a shingled product arrangement (64 *a-k*), during a transportation movement (28 *a-k*). The product stacking device includes at least two stack contact surfaces (20 *a-k*), which are provided in order to form the product stack (12 *a-k*) by reducing a spacing (24 *a-k*) between the stack contact surfaces (20 *a-k*), the stack contact surfaces lying opposite one another in a product group direction (26 *a-k*).

14 Claims, 6 Drawing Sheets

(51) Int. Cl.

| | |
|---|---|
| ***B65B 23/14*** | (2006.01) |
| ***B65H 29/66*** | (2006.01) |
| ***B65H 31/30*** | (2006.01) |
| ***B65H 33/16*** | (2006.01) |
| ***B65B 35/50*** | (2006.01) |

(52) U.S. Cl.
CPC ..... *B65H 29/6618* (2013.01); *B65H 31/309* (2013.01); *B65H 33/16* (2013.01); *B65H 2301/4212* (2013.01); *B65H 2301/4213* (2013.01); *B65H 2301/42144* (2013.01)

(58) Field of Classification Search
USPC ..... 198/418.9, 419.1
See application file for complete search history.

(56) References Cited

U.S. PATENT DOCUMENTS

| | | | | | |
|---|---|---|---|---|---|
| 3,964,598 | A * | 6/1976 | Alsop | B42C 19/06 | 198/415 |
| 4,502,592 | A * | 3/1985 | Ramcke | B65G 15/10 | 198/626.5 |
| 5,035,315 | A * | 7/1991 | Fukusaki | B65B 23/14 | 198/408 |
| 5,311,722 | A | 5/1994 | Staton | | |
| 5,460,481 | A | 10/1995 | Prakken | | |
| 6,125,990 | A * | 10/2000 | Rupert | B65B 23/14 | 198/418.9 |
| 6,182,814 | B1 * | 2/2001 | Koehler | B65B 23/14 | 198/418.7 |
| 6,293,544 | B1 * | 9/2001 | Fedinatz | B65G 17/26 | 198/626.5 |
| 6,308,817 | B1 | 10/2001 | Corniani et al. | | |
| 7,752,828 | B2 * | 7/2010 | Gudim | B65B 5/068 | 198/803.11 |
| 8,292,061 | B2 * | 10/2012 | Iwasa | B65B 5/061 | 198/407 |
| 2015/0136564 | A1 * | 5/2015 | Hurni | B65B 57/16 | 198/418 |
| 2015/0321857 | A1 * | 11/2015 | Sacchetti | B65B 35/405 | 198/419.2 |

FOREIGN PATENT DOCUMENTS

| | | | |
|---|---|---|---|
| DE | 1927076 | | 12/1969 |
| DE | 69200669 | | 5/1995 |
| DE | 69935695 | | 12/2007 |
| EP | 2204343 | | 7/2010 |
| FR | 1476915 | | 4/1967 |
| GB | 1152333 | | 5/1969 |
| JP | S60170387 | | 11/1985 |
| JP | S6279723 | | 5/1987 |
| JP | S6423905 | | 1/1989 |
| JP | H0444501 | Y2 * | 10/1992 |
| JP | 2007230751 | | 9/2007 |
| JP | 2011105396 | | 6/2011 |

* cited by examiner

PRODUCT STACKING DEVICE

BACKGROUND OF THE INVENTION

Product stacking devices for forming product stacks of product groups consisting of products which lie flatly and/or are brought into a shingled product arrangement during a transportation movement are already known. The product stacking devices comprise at least two stop means with stack contact surfaces which are provided in order to form the product stack.

SUMMARY OF THE INVENTION

The invention relates to a product stacking device for forming product stacks of product groups consisting of products which lie flatly and/or are brought into a shingled product arrangement during a transportation movement. The product stacking device comprises at least two stop means with stack contact surfaces which are provided in order to form the product stack.

A merging unit is provided for forming at least one product stack by reducing a spacing between stack contact surfaces of at least two stop means, said stack contact surfaces lying opposite one another in a product group direction. A disk-shaped foodstuff, in particular a biscuit, is preferably to be understood in this context by the term "product". Other stackable products are however also conceivable. The product stacks are preferably provided for packaging on a packaging machine, in particular a horizontal tube packaging machine known to the person skilled in the art and/or a roll packaging machine and/or a cartoning machine. A product arrangement which "lies flatly" refers in this context particularly to an arrangement in which products are carried while arranged side by side and lying flat by a product support, such as a conveyor belt and/or a conveying surface. A "stop means" is particularly to be understood in this context as a means which is provided to transfer at least a force and/or position to a product or a product group by means of mechanical contact.

A "shingled product arrangement" refers in this context particularly to a product arrangement in which, with the exception of a last product, products bear respectively in a shingle direction with one side on a proximate adjacent product, wherein a succeeding product in turn bears on an opposite side of the product in a direction opposite to the shingle direction. In the shingled product arrangement, the last product in the shingle direction can bear on a product support and/or a stack contact surface. The term "shingle direction" is to be understood in this context preferably as a direction parallel to the direction of transportation in which the products are inclined starting from a line perpendicular to the direction of transportation. The shingle direction is preferably identical to the direction of transportation. In a further embodiment of the invention, it is also possible for the shingle direction to be disposed at an angle, in particular a right angle, to the direction of transportation. In a shingled product arrangement, primary surfaces of adjacent products can particularly overlap by more than 10%, preferably by more than 30% and especially preferably by more than 50%. Primary surfaces of adjacent products in the shingled arrangement preferably overlap by less than 90%, especially preferably by less than 80%. The two largest surfaces of a product are particularly to be understood in this context as "primary surfaces". A shingle angle, which the primary surfaces of the products form with the product support in the shingled product arrangement, amounts to 15°-60°, particularly preferably 25°-35°. All products of a product group assume a shingled product arrangement. A product which is last in the shingle direction can alternatively lie flatly on the product support and the further products can be present in a shingled product arrangement, wherein the last shingled product in the direction of the shingle direction rests on the flatly lying last product. If the products in this alternative arrangement are inclined in the direction of transportation, the product last in the direction of transportation preferably lies flatly on the product support. If the products are inclined oppositely to the direction of transportation, the product which is first in the direction of transportation preferably lies flatly on the product support. This arrangement can be particularly suited to forming a vertical product stack. Shingled product arrangements are known to the person skilled in the art. A "product stack" is particularly to be understood in this context as a product arrangement in which primary surfaces of the products enclose an angle of at least substantially 0° or 90° with a horizontal product support and/or a horizontal. A "horizontal" is particularly to be understood in this context as a direction perpendicular to a weight force and/or the direction of conveyance. A horizontal product stack results at an angle of substantially 0° and a vertical product stack at an angle of substantially 90°. The term "at least substantially" is to be understood in this context as a deviation of less than 15°, preferably less than 10°, and especially preferably less than 5°. Products of a product stack preferably have an overlap of more than 80%, especially preferably of more than 90%. A transition from a shingled product arrangement to a product stack preferably can take place continuously. The product stacking device is preferably provided to transfer products supplied lying flat into a shingled product arrangement prior to stacking. A "transportation movement" refers in this context particularly to a movement in a direction of conveyance. The transportation movement is preferably provided to transport the products to a further manufacturing process, in particular to a packaging process. The direction of conveyance can change the direction thereof at least along sub-regions of a transport route, in particular continuously. The transportation movement is preferably continuous at least in one operating state. The term "continuous" is particularly to be understood in this context as without stoppages. Changes in speed of the transportation movement are preferably constant. A "stack contact surface" is to be particularly understood in this context as an area of a stop means, whereat at least one product of a product group and/or a product stack touches the stop means. The stack contact surface can be approximately linear and/or punctiform. A "merging unit" is particularly to be understood in this context as a unit which is provided to reduce the distance between stack contact surfaces in the product group direction. The merging unit can particularly comprise a plurality of mechanical and/or electronic control units, one or a plurality of bearing units or one or a plurality of fastening units. The merging unit can particularly contain mechanical linkages and/or link controls and/or angular faces. Mechanical linkages, link controls and/or angular faces can particularly be provided to control, contingent on a position and/or a movement, at least one further position and/or movement, such as, in particular, a translation and/or a rotation of at least one stop means. Such devices are known to the person skilled in the art. A "product group direction" refers particularly in this context to a mean direction, along which the supplied products of a product group are disposed adjacent to one another or in a shingled manner. A "spacing" between the stack contact surfaces in the product group direction is particularly to be understood in this context as a mean distance, which is measured in the product group direction, between areas of the stack contact surfaces lying opposite one another which are touched by products of a product group during stacking at the point in time of determining the spacing. The product stack can be effectively formed by pushing together a supplied product arrangement. A continuous stacking can be especially simple. The transportation movement can be without interruption. The product stacking device can thus operate highly efficiently. Many product stacks can particularly be formed per each time unit. The product stacks can be transported very easily in the direction of the further manufacturing process.

The invention furthermore proposes that at least one stop means is formed by a driver and/or a counter holder of a delivery device. A "delivery device" is particularly to be understood in this context as a device which is provided to supply products and/or product stacks to a packaging process of a packaging machine. The delivery device can particularly take on products lying flat or shingled in a product arrangement and transfer the same as a product stack to the packaging machine at the end of the transport route. A "driver" refers in this context particularly to an element which is provided to push and/or carry at least one product or a product group in the direction of transportation by means of a frictional connection or a positive locking connection. A "counter holder" is particularly to be understood in this context as an element which is provided to support at least one product or a product group against the direction of transportation by means of a frictional connection and/or preferably a positive locking connection. The counter holder can particularly be provided to prevent a tipping of products. The drivers and/or counter holders can transport the products and form the product stacks. Components can thus be saved. The delivery device can comprise the product stacking device. A particularly cost effective and compact design can be made possible. The delivery device can particularly contain a conveying system circulating around a preferably closed path, such as a chain and/or a guide channel designed as a closed loop. The transport route can particularly be part of the path of the conveyance system. Drivers and/or counter holders can preferably be movably mounted on the conveyance system in the direction of conveyance at least in the area of the transport route. A drive system, in particular the chain, can be provided to drive the drivers and/or counter holders along the path. In a particularly preferred manner, the drivers and/or counter holders can be individually driven at least in sub-regions of the conveyance path, in particular by means of a linear motor system. The conveyance system can preferably have at least one primary part of a linear motor system. The drivers and/or counter holders can preferably be disposed on conveying elements which comprise secondary parts of the linear motor system, in particular permanent magnets. Drivers and counter holders can be moved in a particularly flexible manner. Distances between driver and counter holder can, in particular, vary. Spacings between the stop means can be flexibly adapted. Product stack lengths and/or product group lengths can be easily adapted. Product stacks having in each case a different length and/or in each case a different number of products can be formed.

At least one bearing unit is furthermore proposed, by means of which at least one of the stop means can be rotatably mounted about at least one degree of freedom. The bearing unit can particularly be part of the merging unit. The spacing between stack contact surfaces of two stop means, which contact surfaces lie opposite one another, can be effectively reduced by rotating at least one of the stop means. The stop means can preferably be rotatably mounted about an axis which is at least substantially transverse, i.e. at an angle of 90° relative to the product group direction. The phrase "at least substantially" is to be understood in this context as a deviation of less than 30°, preferably less than 10° and especially preferably less than 5°. The bearing unit can rotatably mount the stop means to conveying means, such as a chain, and/or to conveying elements of the delivery device. The spacing between stack contact surfaces lying opposite one another in a product group direction, between a stop means disposed on the delivery device and designed, in particular, as a driver and rotatably mounted stop means, can be effectively reduced. A rotatably mounted stop means can effectively influence a shingle angle of the shingled product arrangement and convert said shingle angle into an angle of a product stack. At least two stop means, in particular a driver and a counter holder, which are provided to form a product stack can advantageously be rotatably mounted on bearing units. A shingle angle and a spacing between stack contact surfaces can effectively be set. A product stacking can be especially gentle on the product. It is possible in a further embodiment of the invention for further stop means to be rotatably mounted on at least one bearing unit. The further bearing unit can preferably be disposed on a side of the product groups which lies opposite the delivery device in the direction opposite to a weight force. Further possible arrangements of a mounting of the further stop means are also conceivable. The further stop means can effectively support a product stacking. Counter holders of a delivery device that are moved along the delivery direction can be omitted.

At least one bearing unit is further proposed, via which at least one of the stop means is translationally movably mounted in at least one degree of freedom at least along a working section. The bearing unit can particularly be part of the merging unit. The spacing between stack contact surfaces of two stop means, said stack contact surfaces lying opposite one another, can be effectively reduced by a translational movement of at least one stop means at least substantially in the product group direction.

At least one drive unit is further proposed with which the at least one stop means can be driven in at least one degree of freedom.

The drive unit can particularly have an actuator like a rotary cylinder, a stepper motor and/or in particular a servo drive and/or comprise a link control. A control unit of the merging unit can be provided to open-loop and/or close-loop control a movement of the stop means in the degree of freedom. The degree of freedom can particularly be a rotation or a translation. The control unit can effectively set the spacing between stack contact surfaces of two stop means, said stack contact surfaces lying opposite one another.

The invention further proposes that the merging unit is provided to form the at least one product stack by actuating the at least one drive unit. The merging unit can particularly reduce the spacing between stack contact surfaces lying opposite one another in the product group direction; thus enabling a product group to be pushed together to a product stack. If a desired stack length is achieved, the merging unit can at least substantially keep the spacing constant between stack contact surfaces lying opposite one another in the product group direction. Force measuring devices can preferably be provided which signal an increase in a force between the stop means, said force being caused by the product stack, if the product stack length is achieved and/or undershot. The force measuring devices can be provided on the stop means and/or on the bearing means of the stop means. Drive variables of the drive units of the stop means can preferably be used to determine a force, in particular drive currents and/or torques and/or forces. A particularly gentle and flexible stacking can then be made possible.

The invention further proposes that at least one stop means has stack contact surfaces on two sides lying opposite one another in the product group direction. Product stacks can particularly be formed in each case between stop means disposed successively in the product group direction. A stop means can simultaneously form a stack contact surface of a product stack and a further stack contact surface of a product stack that is adjacent in the product group direction. The number of the stop means can be reduced. The product stack device can be particularly compact and cost-effective.

It is furthermore proposed that the merging unit comprises at least one link control. The link control can have, in particular, a connecting link that is fixedly mounted to the product stack device and/or to the delivery device. The link control can particularly be provided to displace and/or pivot the stop means on the basis of position. The stacking can take place in a mechanically controlled manner, in particular on the basis of a position of the product group and/or the stop means along the transport route. Additional controlled drives, in particular servo- and/or linear motors for controlling the stacking can be omitted. The product stacking device can thus be particularly cost effective.

The invention further proposes that the merging unit comprises at least one electrical and/or electronic control unit. The control unit can preferably be provided for individually closed-loop or open-loop controlling spacings between stack contact surfaces of stop means, said stack contact surfaces lying opposite one another in a product group direction. The stacking can be especially flexible. Different stack lengths can be possible. In particular, a mechanical changeover and/or a modification to the product stacking device for forming product stack of different lengths can be avoided.

According to an alternative embodiment of the invention, the merging unit comprises at least one stop means that is formed from a lateral guide which is angled with respect to the transportation movement. The merging unit preferably comprises at least two stop means which lie opposite one another in a product group direction and are formed from angled lateral guides. The stop means are preferably angled in such a manner that the spacing between stack contact surfaces lying opposite one another in the product group direction decreases in the direction of the transportation movement. The transportation movement is preferably at least substantially transverse to the product group direction. The stacking preferably takes place at least substantially by means of a reduction in the product group length transversely to the direction of transportation. The term "at least substantially" is to be particularly understood in this context as a deviation by less than 30°, preferably by less than 15°, and especially preferably by less than 5°.

The product groups are preferably led past the stack contact surfaces by means of the transportation movement in such a way that said product groups are pushed together due to the spacing thereof being reduced in the direction of transportation. The spacing of the lateral guides with respect to one another and the angle of the angled position with respect to the product group direction and/or the transportation movement can preferably be adjusted with the aid of a suitable, adjustable bearing device of the lateral guides. The stacking can take place by means of a static arrangement of elements of the merging unit. The merging unit can be especially simple in design. An open-loop or closed-loop control of movements and/or drives for the purpose of stacking can be omitted. A large number of product stacks can successively be formed in a continuous manner between the stop means. The product adapter unit can be especially efficient. The lateral guides can be designed as fences. The lateral guides preferably comprise circulating belts and/or bands. Friction between product groups and lateral guides can be minimized. The product stacks can be formed in a very protective manner.

According to one variant of the invention, at least one of the stop means is provided to space the product groups of the delivered products apart from one another. In particular, the stop means can be guided between two successive product groups of the products delivered lying flat and/or in a shingled product arrangement. The product groups can be separated by the stop means and be spaced apart from one another by said stop means. The product group is formed from a number of products which are to form a product stack. The product groups of the products delivered lying flat or in a shingled product arrangement can be delivered to the product stacking machine without the product groups already being spaced apart from one another. A separate device provided to space apart product groups is thus rendered unnecessary. The product groups can preferably be spaced apart from one another by drivers of the product stacking device. The drivers can advantageously be guided between product groups, space apart said product groups from one another and thereby form product stacks by said drivers pushing the product groups during the transportation movement against respectively one counter holder. Thus, the product stacking device can very efficiently space product groups apart from one another and form product stacks.

According to a further variant of the invention, an input belt is provided, at least in a first step of forming the product stack, to push the product groups lying on the input belt with the transportation movement against slower moving stop means moving opposite to the transportation movement. The products delivered lying flat and/or in a shingled product arrangement are preferably placed onto the input belt and/or are transported by the input belt during the transportation movement. The input belt preferably has a gap, through which the stop means protrudes. The input belt can particularly be formed by two parallel belts, between which a gap is formed through which the stop means protrudes. The products can preferably be individually dispensed onto the input belt from a feed belt. The stop means can be designed as a counter holder and is moved slower with respect to the transportation movement of the input belt. The products are pushed by the input belt against the counter holder and form a shingled product arrangement. Due to the faster movement of the input belt in comparison to the counter holder, the shingle angle of the product arrangement can become increasingly steeper during the transport. The second stop means is advantageously designed as a driver and forms a product stack in a second step by reducing the spacing between the stack contact surfaces of the stop means, said stack contact surfaces lying opposite one another in the product group direction. The input belt can advantageously support the product stacking. The first step of the product stacking by means of the input belt can particularly be performed in a product protective manner. Damage to the products can thus be prevented.

According to the invention, a method for forming at least one horizontal or vertical product stack using a previously described product stacking device is proposed. Two stop means can quickly and effectively push shingled product groups together to form a product stack by reducing the spacing between stack contact surfaces lying opposite one another in the product group direction. In order to form a vertical product stack, a first or last product of the product group can particularly be disposed in a product configuration that lies flat. Further products can be disposed in a shingled product configuration, wherein the product adjacent to the product that lies flatly rests on the same. When the spacing between the stack contact surfaces is reduced, the products can be pushed together to form a vertical product stack. In order to form a horizontal product stack, all of the products of a product group can especially be disposed in a shingled product arrangement. By reducing the spacing between the stack contact surfaces, the shingle angle can be enlarged until the shingled product arrangement passes into a horizontal product stack. A fast and simple stacking can thereby be implemented. The stacking can take place in a continuous movement, in particular conjointly with a transportation movement.

According to the invention, provision is furthermore made for a delivery device, in particular for delivering products to a packaging process, comprising a product stacking device. The product stacking device can particularly be integrated into the delivery device. Conveying elements of the delivery device can form stop means of the product stacking device. Components can thus be saved. A particularly compact design of the delivery device comprising the product stacking device can thus be made possible. In a particularly preferred manner, the delivery device can be part of a packaging machine. The packaging machine can have the aforementioned advantages.

BRIEF DESCRIPTION OF THE DRAWINGS

Further advantages ensue from the following description of the drawings. Exemplary embodiments of the invention are depicted in the drawings. The drawings, the description and the claims contain numerous features in combination. The person skilled in the art will also expediently consider the features in isolation and put them together to form further useful combinations.

In the Drawings.

DETAILED DESCRIPTION

Figure 1:
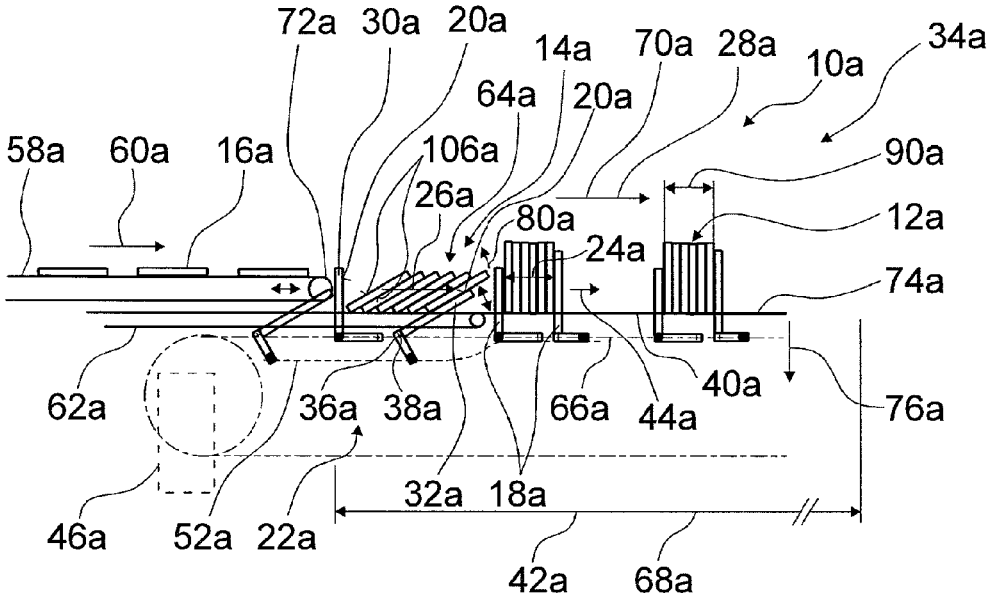
FIG. 1 shows a schematic depiction of a delivery device comprising a product stacking device in a first exemplary embodiment.
Figure 10:
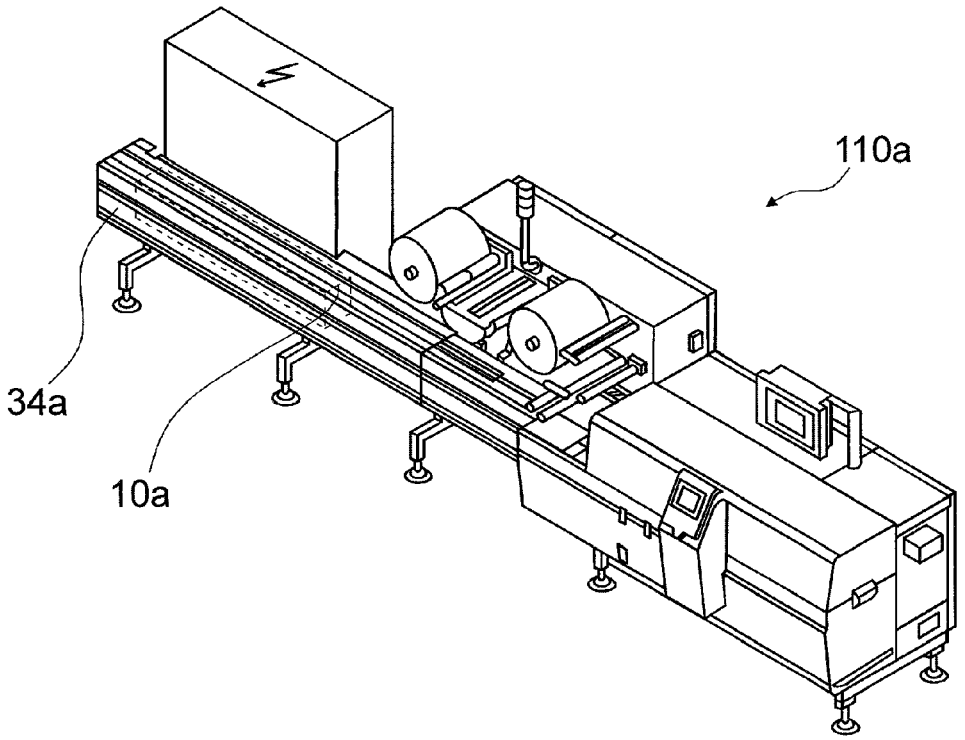
FIG. 10 shows a schematic depiction of a packaging machine comprising the product stacking device of the first exemplary embodiment.

FIG. 1 shows a product stacking device 10*a* for forming product stacks 12*a* of product groups 14*a* consisting of products 16*a* delivered lying flat during a transportation movement 28*a*, said stacking device comprising stop means 18*a* with stack contact surfaces 20*a* which are provided in order to form the product stack 12*a*. The product stacking device 10*a* has a merging unit 22*a* which is provided for forming the product stack 12*a* by reducing a spacing 24*a* between stack contact surfaces 20*a* of two stop means 18*a*, said stock contact surfaces lying opposite one another in the product group direction 26*a*. The product stacking device 10*a* is part of a delivery device 34*a* of a packaging machine 110*a* (FIG. 10). In the example shown, a web of products 16*a* is delivered to the product stacking device 10*a*. In an extension of the exemplary embodiment depicted here, a multi-web embodiment is also possible in which a plurality of webs of products 16*a* is supplied in parallel in order to form a plurality of product stacks 12*a* in juxtaposition. As a result, the stop means 18*a* can simultaneously form a plurality of product stacks 12*a* disposed adjacent to one another, or a plurality of stop means 18*a* can be provided side by side.

The products 16*a* are placed via a feed belt 58*a* in a delivery direction 60*a* onto an input belt 62*a* so as to lie flatly. In so doing, product groups 14*a* are formed in a shingled product arrangement 64*a*. The stop means 18*a* are formed by drivers 30*a* and counter holders 32*a* of the delivery device 34*a*. The drivers 30*a* and the counter holders 32*a* are mounted on a circulating chain 66*a* and are moved along a transport route 68*a* in the direction of conveyance 70*a*. The feed belt 58*a* can be designed as a so-called "pullnose" belt in which a belt end 72*a* is movable in the delivery direction 60*a* in order to facilitate a formation of gaps between the product groups 14*a*. Different solutions are known here to the person skilled in the art.

The drivers 30*a* are provided to push the product groups 14*a* resting on the product support 74*a* in the direction of conveyance 70*a* towards a packaging machine at the end of the transport route 68*a*, said packaging machine not being depicted in detail here. The drivers 30*a* are retractably mounted on the chain 66*a* in a direction perpendicular to the direction of conveyance 70*a*; thus enabling said drivers to be lowered by means of a link control, which is not depicted here in detail, under the product support 74*a* in the area of the feed belt 58*a* as a result of a pivoting movement. After a product group 14*a* has been formed with a desired number of products 16*a*, the driver 30*a* is raised, so that said driver can transport the product group 14*a*, which is supported on the product support 74*a* on the basis of a weight force 76*a*, by means of a positive locking connection. The product group 14*a* has initially the shingled product arrangement 64*a* in the product group direction 26*a*, which is parallel to the direction of conveyance 70*a*, at a shingle angle 78*a* between primary surfaces 106*a* of the products 16*a* and the product support 74*a* of less than 45°. The counter holders 32*a* are provided to support the product groups 14*a* resting on the product support 74*a* against the direction of conveyance 70*a*. Drivers 30*a* and counter holders 32*a* form stop means 18*a* of the product stacking device 10*a* and touch the product groups 14*a* with stack contact surfaces 20*a*.

Bearing units 36*a* mount the stop means 18*a* designed as counter holders 32*a* on the chain 66*a* so as to be rotatable about one degree of freedom 38*a*. The product support 74*a* comprises a bearing unit 40*a* which mounts the stop means 18*a* in a translationally movable manner along a working section 42*a* that corresponds to the transport route 68*a* in one degree of freedom 44*a* along the direction of conveyance 70*a*. A drive unit 46*a* drives the chain 66*a*. The stop means 18*a* designed as drivers 30*a* are driven by the chain 66*a* in the translational degree of freedom in the direction of conveyance. Due to the movement of the drive unit 46*a*, a link control 52*a* moves the stop means 18*a* designed as counter holders 32*a* in the degree of freedom 38*a* in a pivoting movement 80*a*.

The stop means 18*a* with the link control 52*a* and the bearing units 36*a* and 40*a* are part of the merging unit 22*a*. The pivoting movement 80*a* causes a reduction in the spacing between the stack contact surfaces 20*a* of the driver 30*a* and the counter holder 32*a*, said stack contact surfaces lying opposite one another in the product group direction 26*a*. The product groups 14*a* are, starting from the shingled product arrangement 64*a*, raised to a horizontal product stack 12*a*. Drivers 30*a* and counter holders 32*a* are now moved synchronously in the direction of conveyance 70*a* and transfer the product stacks 12*a* to a packaging process of the packaging machine at the end of the transport route 68*a*. In a variant which is not depicted here in detail, the counter holders 32, relative to the chain 66*a*, are additionally movably mounted translationally in the direction of conveyance 70*a* against a spring force or by means of a drive that can be controlled in an open-loop or closed-loop system. A product stack length 90*a* can thus be additionally adapted.

The following description and the drawings of further exemplary embodiments are substantially limited to the differences between the exemplary embodiments, wherein, with regard to identically denoted components, in particular to components having the same reference signs, reference can basically be made to drawings and/or the description of the other exemplary embodiments. In order to differentiate the exemplary embodiments, the letters b to k are placed behind the reference numerals in the further exemplary embodiments instead of the letter "a" of the first exemplary embodiment.

Figure 2:
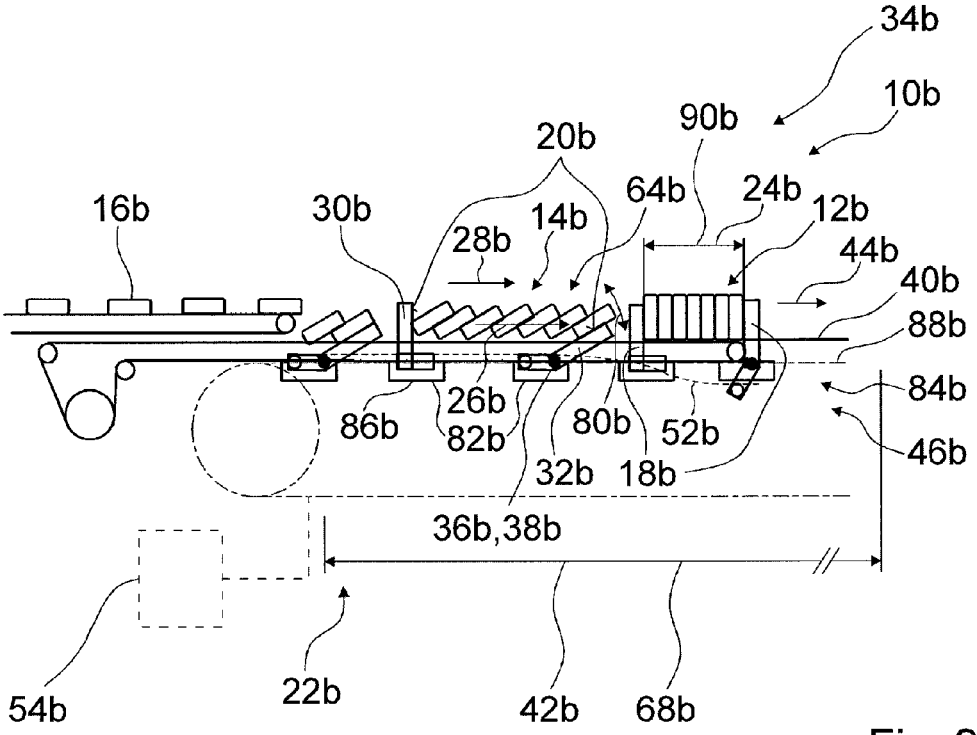
FIG. 2 shows a schematic depiction of a delivery device comprising a product stacking device in a second exemplary embodiment.

FIG. 2 shows a product stacking device 10*b* for forming product stacks 12*b* of product groups 14*b* consisting of products 16*b* delivered lying flat during a transportation movement 28*b*, comprising stop means 18*b* with stack contact surfaces 20*b* which are provided for forming the product stack 12*b* in a second exemplary embodiment.

The product stacking device 10*b* differs from the first exemplary embodiment particularly by virtue of the fact that the stop means 18*b* designed as drivers 30*b* and counter holders 32*b* of a delivery device 34*b* are disposed on conveying elements 82*b* which can be individually driven in a position-controlled and speed-controlled manner by means of a drive unit 46*b* formed from a linear motor system 84*b*. The conveying elements 82*b* each comprise a secondary part 86*b* of the linear motor system 84*b*. Instead of a chain, the delivery device 34*b* contains a primary part 88*b* disposed along a circumferential path and comprising electromagnets that can be individually actuated. An electronic control unit 54*b* individually controls position and speed of the conveying elements 82*b*. The control unit 54*b* forms with the linear motor system 84*b* and the conveying elements 82*b* comprising the stop means 18*b* a merging unit 22*b*. The control unit 54*b* controls position and speed of the stop means 18*b* during the transportation movement 28*b* to a packaging process in such a way that a spacing 24*b* between stack contact surfaces 20*b* of at least two stop means 18*b* is reduced, said stack contact surfaces lying opposite one another in a product group direction 26*b*. In so doing, the counter holders 32*b* are mounted on the conveying elements 82*b* by means of bearing units 36*b* so as to be rotatable about one degree of freedom. A pivoting movement 80*b* is controlled by a link control 52*b* independently of a position along a transport route 68*b*. The spacing 24*b* is determined by a superimposition of the pivoting movement 80*b* as well as by the relative positions of the stop means 18*b* with respect to each other which are controlled by the control unit 54*b*. Starting from a shingled product arrangement 64*b*, the product group 14*b* can be raised to a horizontal product stack 12*b* by combining the pivoting movement 80*b* with a translation of the stop means 18*b* in the direction of conveyance 70*b*. Different product stack lengths 90*b* can be set by the control unit 54*b* without a mechanical format changeover or a modification of the product stack device 10*b*. It is also possible that product stacks 12*b* that are successive in the direction of conveyance 70*b* have different product stack lengths 90*b*.

Figure 3:
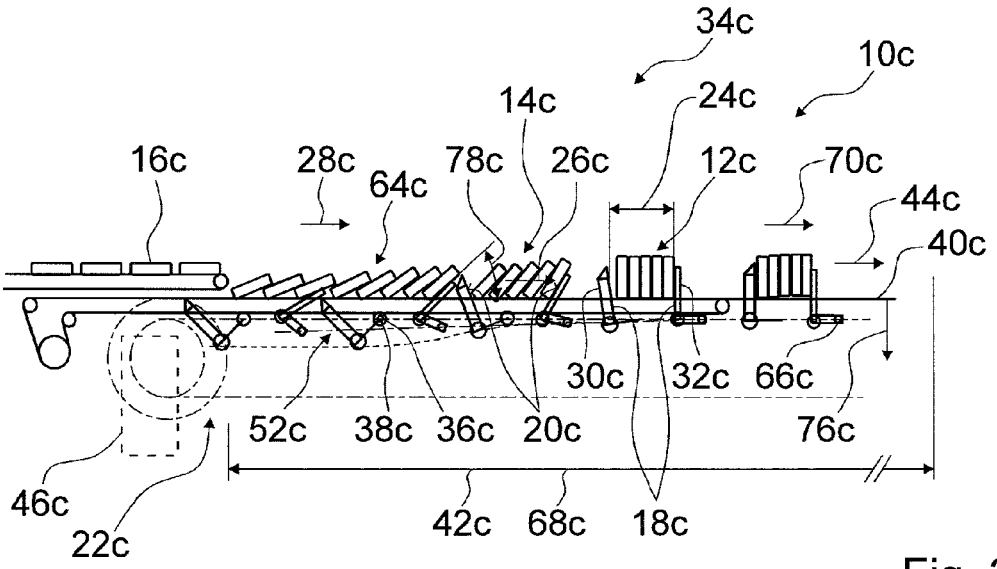
FIG. 3 shows a schematic depiction of a delivery device comprising a product stacking device in a third exemplary embodiment.

In a third exemplary embodiment, FIG. 3 shows a product stacking device 10*c* for forming product stacks 12*c* of product groups 14*c* consisting of products 16*c* delivered lying flat during a transportation movement 28*c*, comprising stop means 18*c* with stack contact surfaces 20*c* which are provided for forming the product stacks 12*c*. The product stacking device 10*c* differs from the product stacking device 10*a* of the first exemplary embodiment particularly by virtue of the fact that drivers 30*c* and counter holders 32*c* of a delivery device 34*c* are rotatably mounted on bearing units 36*c* in one degree of freedom 38*c* on a chain 66*c*. A movement about the degree of freedom 38*c* of the drivers 30*c* and the counter holders 32*c* is controlled via a link control 52*c*. Drivers 30*c*, counter holders 32*c* and link control 52*c* are part of a merging unit 22*c*. A shingle angle 78*c* of the product groups 14*c* is influenced by the counter holders 32*c*. The counter holders 32*c* tilt up with respect to a weight force 76*c* along a transport route 68*c* during product stacking; thus enabling the shingle angle to increase. The drivers 30*c* are likewise raised along the transport route 68*c* until drivers 30*c* and counter holders 32*c* are perpendicular to a direction of conveyance 70*c*. A spacing 24*c* between stack contact surfaces 20*c* of the stop means 18*c* designed as drivers 30*c* and counter holders 32*c*, said stack contact surfaces lying opposite one another in a product group direction 26*c*, is reduced such that horizontal product stacks 12*c* are formed. The product stacks 12*c* are formed in a particularly product protective manner as a result of the drivers 30*c* and counter holders 32*c* being simultaneously raised.

Figure 4:
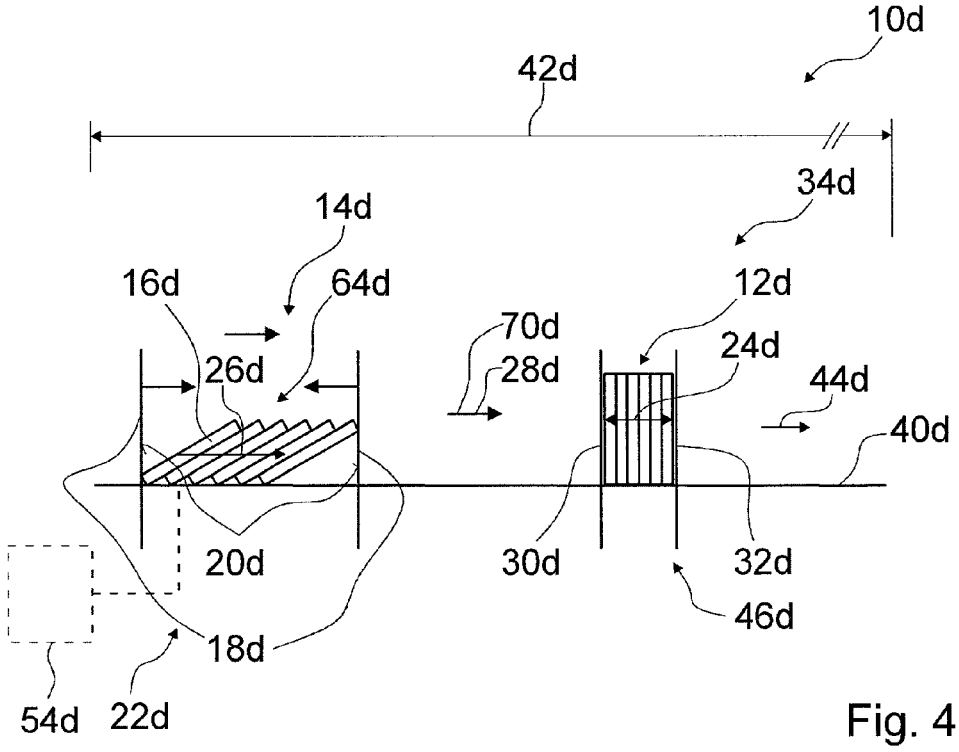
FIG. 4 shows a schematic depiction of a section of a delivery device comprising a product stacking device in a fourth exemplary embodiment.

In a fourth exemplary embodiment, FIG. 4 shows a product stacking device 10*d* for forming product stacks 12*d* of product groups 14*d* consisting of products 16*d* delivered in a shingled product arrangement 64*d* during a transportation movement 28*d*, comprising stop means 18*d* with stack contact surfaces 20*d* which are provided for forming the product stacks.

The product stacking device 10*d* differs from the second exemplary embodiment particularly in that the stop means 18*d* designed as drivers 30*d* and counter holders 32*d* are moved in a translation superimposed on the transportation movement 28*d* in and/or opposite to a direction of conveyance 70*d* for the purpose of reducing a spacing 24*d* between stack contact surfaces 20*d* which lie opposite one another in a product group direction 26*d*. Drivers 30*d* and counter holders 32*d* are part of a merging unit 22*d*. A bearing unit, which facilitates a pivoting movement, can be omitted. The design is particularly simple and cost effective.

Figure 5:
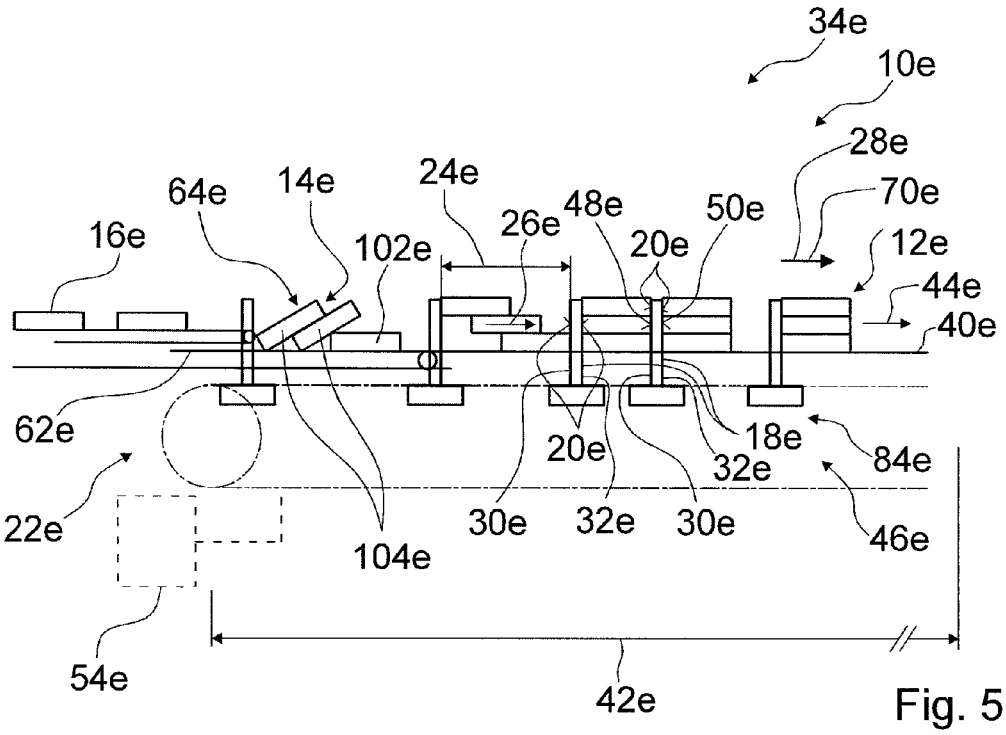
FIG. 5 shows a schematic depiction of a delivery device comprising a product stacking device in a fifth exemplary embodiment.

In a fifth exemplary embodiment, FIG. 5 shows a product stacking device 10*e* for forming product stacks 12*e* of product groups 14*e* consisting of products 16*e* delivered lying flat during a transportation movement 28*e*, comprising stop means 18*e* with stack contact surfaces 20*e* which are provided for forming the product stacks 12*e*.

The product stacking device 10*e* differs from the second exemplary embodiment particularly by the fact that the stop means 18*e* have stack contact surfaces 20*e* on two sides lying opposite one another in a product group direction 26*e*. The product stacking device 10*e* is provided for forming vertical product stacks 12*e*. A stop means 18*e* simultaneously assumes the function of a driver 30*e* of a product group 14*e* and a counter holder 32*e* of a succeeding product group 14*e* moving against a direction of conveyance 70*e*. The number of stop means 18*e* is reduced in relation to the preceding exemplary embodiments.

Prior to stacking, the product 102*e* of the delivered product group 14*e* which is last in the direction of conveyance 70*e* lies flatly in each case on an input belt 62*e*, while further products 104*e* of the product group 14*e* are disposed in a shingled product arrangement 64*e*. The shingled further products 104*e* are directly or indirectly supported on the last product 102*e*. If a spacing 24*e* between stack contact surfaces 20*e* lying opposite one another in the product group direction 26*e* is reduced, the further products 104*e* are pushed onto the last product 102*e*; thus enabling a vertical product stack 12*e* to form. The stop means 18*e* driven by a drive unit 46*e* together with a control unit 54*e* provided for controlling the position and speed of the stop means 18*e* belong to a merging unit 22*e*. The drive unit 46*e* is designed as a linear motor system 84*e* as in the second exemplary embodiment and is provided to individually drive the stop means 18*e*.

Figure 6:
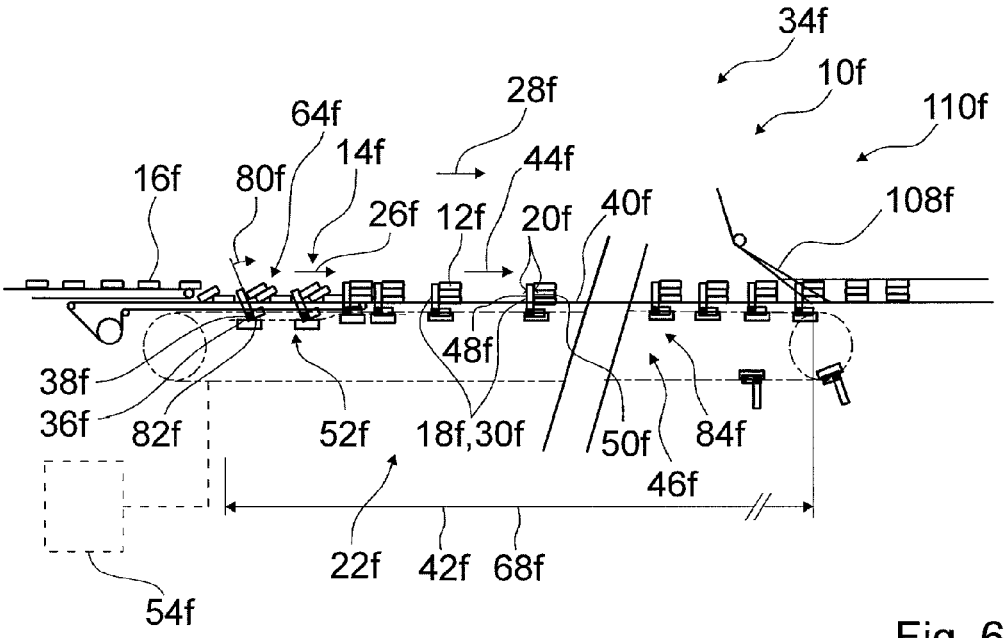
FIG. 6 shows a schematic depiction of a delivery device comprising a product stacking device in a sixth exemplary embodiment.

In a sixth exemplary embodiment, FIG. 6 shows a product stacking device 10*f* for forming product stacks 12*f* of product groups 14*f* consisting of products 16*f* delivered lying flat during a transportation movement 28*f*, comprising stop means 18*f* with stack contact surfaces 20*f* that are provided for forming the product stacks 12*f*.

The product stacking device 10*f* differs from the fifth exemplary embodiment in particular in that the stop means 18*f* on bearing units 36*f* are rotatably mounted on conveying elements 82*f*. The forming of product stacks 12*f* is supported by an additional pivot movement 80*f* and takes place in a very product protective manner. The pivoting movement 80*f* is controlled by a link control 52*f* as a function of a position of the stop means 18*f* along a transport route 68*f*. A linear motor system 84*f* serves to provide an independent open-loop and closed-loop control of speed and position of the stop means 18*f* by means of a control unit 54*f*. The stop means 18*f*, the link control 52*f*, the bearing units 36*f* and a drive unit 46*f* designed as a linear motor system 84*f* are parts of a merging unit 22*f*. At the end of the transport route 68*f*, the product stacks 12*f* are encased in a film tube 108*f* during a packaging process of a packaging machine 110*f*. Individual packages comprising respectively one product stack 12*f* are formed from the film tube 108*f* by a sealing unit which is not depicted here in detail.

Figure 7:
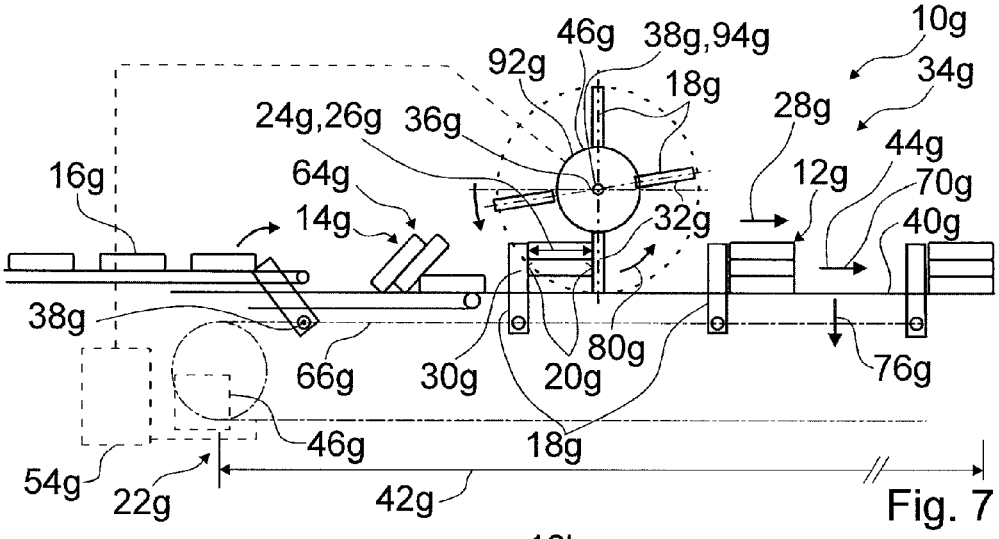
FIG. 7 shows a schematic depiction of a delivery device comprising a product stacking device in a seventh exemplary embodiment.

In a sixth exemplary embodiment, FIG. 7 shows a product stacking device 10*g* for forming product stacks 12*g* of product groups 14*g* consisting of products 16*g* delivered lying flat during a transportation movement 28*g*, comprising stop means 18*g* with stack contact surfaces 20*g* that are provided for forming the product stacks 12*g*.

The product stack device 10*g* differs from the first exemplary embodiment particularly in that the stop means 18*g* designed as counter holders 32*g* are rotatably mounted about a bearing unit 36*g*, wherein the bearing unit 36*g* in the depicted example is disposed opposite to a weight force 76*g* above the product groups 14*g*. It is also conceivable in an alternative configuration for at least one bearing unit of stop means to be disposed next to the product groups 14*g* in relation to the transportation movement or below said product groups 14*g* in relation to the weight force 76*g*. The stop means 18*g* are disposed on a wheel 92*g* which is mounted on the bearing unit 36*g* so as to be rotatable about a rotational axis 94*g*. Stop means 18*g* designed as drivers 30*g* push the product groups 14*g* in a direction of conveyance 70*g* against one of the counter holders 32*g*. The counter holder 32*g* is oriented at this point in time in the direction of the weight force 76*g* perpendicularly downward. A spacing 24*g* between stack contact surfaces 20*g* of the counter holders 32*g* and drivers 30*g*, said stack contact surfaces lying opposite one another in the product group direction 26*g*, is reduced so that a product stack 12*g* is formed from the product group 14*g*. The counter holder 32*g* is subsequently moved away from the product stack 12*g* by means of a pivoting movement 80*g* about the bearing unit 36*g*; thus enabling the driver 30*g* to further transport the product stack 12*g* underneath the counter holder 32*g* in the direction of conveyance 70*g*. A next counter holder 32*g* for forming a next product stack 12*g* is subsequently oriented downwards. In the example shown, four counter holders 32*g* are disposed on the wheel 92*g*, wherein respectively two counter holders 32*g* lying opposite one another are jointly driven. Successive counter holders 32*g* around the wheel 92*g* can be independently driven; thus enabling the counter holders 32*g* of two successive product groups 14*g* to be synchronized with said product groups 14*g* independently of one another. The movements of the drivers 30*g* and the counter holders 32*g* which are driven by a circulating chain are synchronized by a control unit 54*g*. The stop means 18*g* and the control unit 54*g* are part of a merging unit 22*g*.

Figure 8:
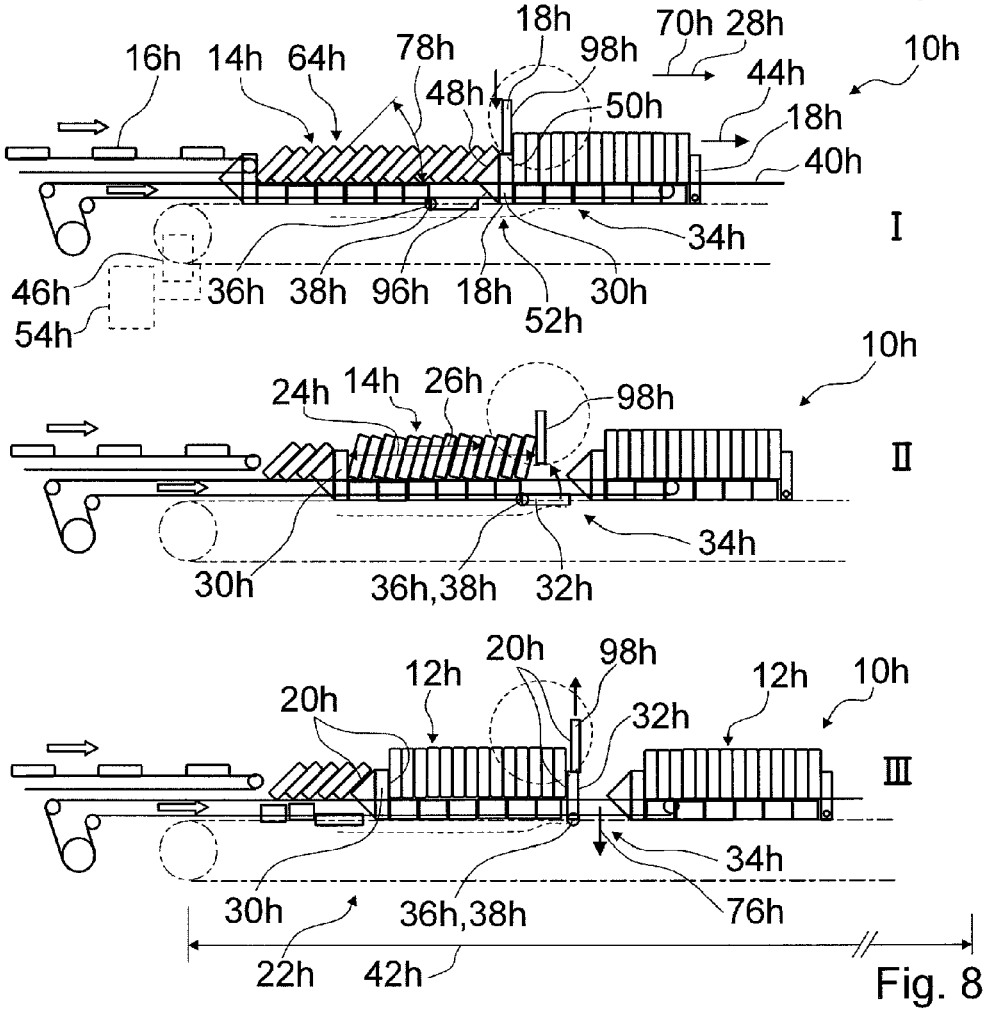
FIG. 8 shows a schematic depiction of a delivery device comprising a product stacking device in an eighth exemplary embodiment.

In an eighth exemplary embodiment, FIG. 8 shows a product stacking device 10*h* for forming product stacks 12*h* of product groups 14*h* consisting of products 16*h* delivered lying flat during a transportation movement 28*h*, comprising stop means 18*h* with stack contact surfaces 20*h* which are provided for forming the product stacks 12*h*.

The product stacking device 10*h* differs from the first exemplary embodiment particularly in that a shingle angle 78*h* of a shingled product arrangement 64*h* generated from the products 16*h* delivered lying flat is secured by stop wedges 96*h*. The stop wedges 96*h* are disposed on a side of the stop means which faces away from a direction of conveyance 70*h*, said stop means being configured as drivers 30*h*. At one end of the product group 14*h* in the direction of conveyance 70*h*, a stop means 18*h* embodied as a support element 98*h* supports the product group 14*h* which initially rests on the stop wedge 96*h* (FIG. 8-I). The drivers 30*h* comprising the stop wedges 96*h* and the support element 98*h* are part of a merging unit 22*h*. The stop wedge 96*h* is moved away in the direction of conveyance 70*h* jointly with the product stack 12*h* which follows in the direction of conveyance 70*h*. The product group 12*h* is moved by the driver 30*h* following the same likewise in the direction of conveyance 70*h* against the support element 98*h*, so that a spacing 24*h* between stack contact surfaces 20*h* of the support element 98*h* and the driver 30*h* is reduced and the product group 14*h* is tilted upwards (FIG. 8-11). A counter holder 32*h* pivotably mounted about one degree of freedom 38*h* on a bearing unit 36*h* on a delivery device 34*h* is pivoted against the product group 14*h* and tilts the product stack 12*h* further up by reducing the spacing 24*h* between the stack contact surfaces 20*h* of the counter holder 32*h* and the driver 30*h*, said stack contact surfaces lying opposite one another in a product group direction 26*h*, until a product stack 12*h* is formed. The support element 98*h* is moved against a weight force 76*h* away from a product support 74*h* upwards and away from the product stack 12*h* (FIG. 8-III). The drivers 30*h* and the counter holders 32*h* jointly transport the product stack 12*h* in the direction of a packaging process.

Figure 9:
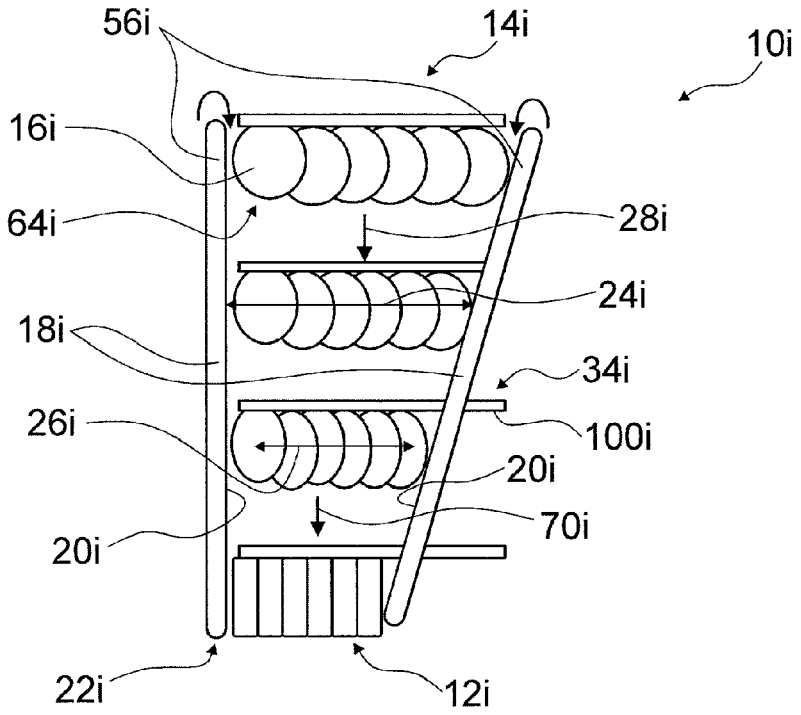
FIG. 9 shows a schematic depiction of a delivery device comprising a product stacking device in a ninth exemplary embodiment.

In a ninth exemplary embodiment, FIG. 9 shows a product stack device 10*i* for forming product stacks of product groups 14*i* consisting of products 16*i* delivered in a shingled product arrangement 64*i* during a transportation movement 28*i*, comprising stop means 18*i* with stack contact surfaces 20*i* which are provided for forming the product stacks 12*i*.

A merging unit 22*i* contains two stop means 16*i* designed as lateral guides 56*i* comprising circulating conveyor belts and a delivery device 34*i* comprising a crossbar chain 100*i*. The product groups 14*i* are transported on the crossbar chain 100*i* having a product group direction 26*i* that is transverse to a direction of conveyance 70*i*. One of the lateral guides 56*i* is mounted on the delivery device 34*i* at such an angle in relation to the transportation movement 28*i* that a spacing 24*i* in the product group direction 26*i* between the stack contact surfaces 20*i* is reduced in the delivery direction 60*i*, whereas the other lateral guide 56*i* is mounted on the delivery device 34*i* parallel to the direction of conveyance 70*i*. Due to the spacing 24*i* being reduced, the product groups 14*l* are pushed together during transport in the direction of conveyance 70*i* to form a horizontal product stack 12*i*.

Figure 11:
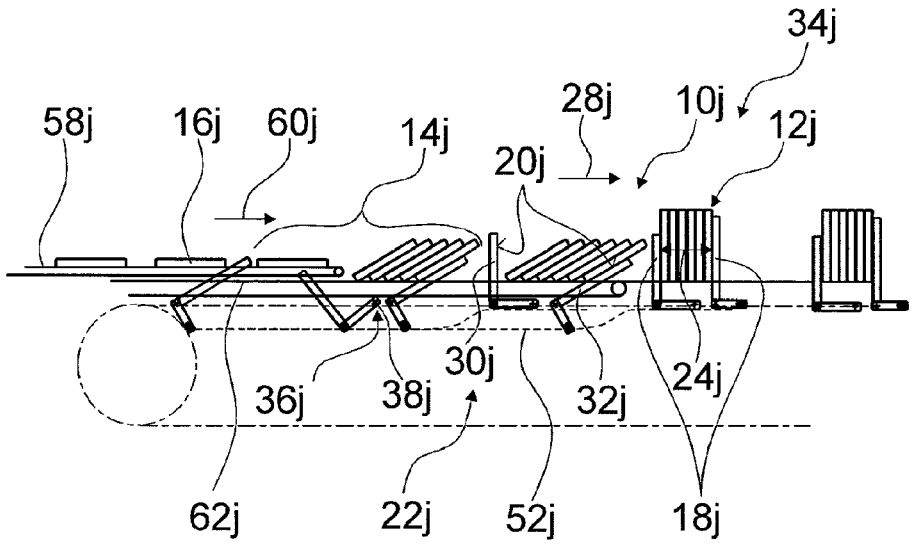
FIG. 11 shows a schematic depiction of a delivery device comprising a product stacking device in a tenth exemplary embodiment.

In a tenth exemplary embodiment, FIG. 11 shows a product stacking device 10*j* for forming product stacks 12*j* of product groups 14*j* consisting of products 16*j* delivered lying flat during a transportation movement 28*j* by means of a merging unit 22*j* comprising stop means 18*j* with stack contact surfaces 20*j* which are provided in order to form the product stacks 12*j* by reducing a spacing 24*j* between stack contact surfaces 20*j* which lie opposite one another in a product group direction. The product stacking device 10*j* differs from the first exemplary embodiment particularly by the fact that stop means 18*j* designed as drivers 30*j* are provided for spacing the product groups 14*j* of the delivered products 16*j* apart from one another. The stop means 18*j* can, for example, be driven by a circulating chain or a linear motor system. The product stacking device 10*j* of this exemplary embodiment is provided to form horizontal product stacks 12*j*. It would likewise be possible to use the particular features of this exemplary embodiment for a product stacking device for forming vertical product stacks. The products 16*j* are delivered flat via a feed belt 58*j* in a delivery direction 60*j* onto an input belt 62*j*. The feed belt 58*j* is configured as a double belt comprising two parallel belts, which are spaced apart from one another. After a certain number of products 16*j* have accumulated, which are to form a product stack 12*j*, one of the drivers 30*j* is guided in each case between two products 16*j* lying on the feed belt 58*j* and thereby separates two successive product groups 14*j*. In order to guide the drivers 30*j* between the products 16*j*, said drivers are rotatably mounted in one degree of freedom 38*j* by means of bearing units 36*j* and are actuated via a link control 52*j* in such a manner that said drivers in each case tilt up perpendicularly to the transportation movement at a location whereat they are to be guided between the products. As an alternative to the link control 52*j*, provision could, for example, also be made for a servomotorical actuation. A formation of gaps between product groups 14*j* using a means configured separately from the merging unit 22*j*, such as a pullnose belt as in the first exemplary embodiment, can thus be omitted. A spacing between stack contact surfaces 20*j* of the driver 30*j* and a second stop means 18*j* designed as a counter holder 32*j* is subsequently in each case reduced in order to form the product stack 12*j*. In order to achieve this end, the rotatably mounted counter holders 32*j* are pivoted by means of the link control 52*j* in opposition to the transportation movement 28*j* against the drivers 30*j*.

Figure 12:
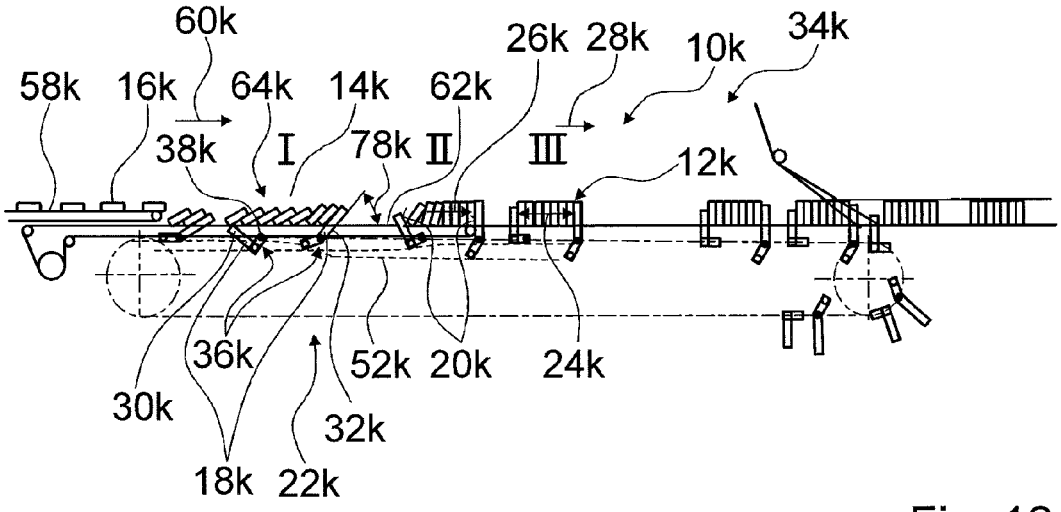
FIG. 12 shows a schematic depiction of a delivery device comprising a product stacking device in an eleventh exemplary embodiment.

In an eleventh exemplary embodiment, FIG. 12 shows a product stacking device for forming product stacks 12*k* of product groups 14*k* consisting of products 16*k* which are delivered lying flat during a transportation movement, comprising a merging unit 22*k* having stop means 18*k* with stack contact surfaces 20*k* which are provided in order to form the product stacks 12*k*. The product stacking device 10*k* of this exemplary embodiment is provided for forming horizontal product stacks 12*k*. It would also be possible to analogously use the particular features of this exemplary embodiment for a product stacking device for forming vertical product stacks. The product stack device differs from the first exemplary embodiment particularly by virtue of the fact that an input belt 62*k* is provided, in a first step of forming the product stacks, to push the product groups 14*k* lying on the input belt 62*k* with the transportation movement 28*k* against stop means 18*k* which are designed as counter holders 32 and are slower moving in relation to the transportation movement 28*k*. The stop means 18*k* can, for example, be driven by a circulating chain or a linear motor system. The products 16*k* are delivered lying flat via a feed belt 58*k* in a delivery direction 60*k* onto the input belt 62*k*. The input belt 62*k* is configured as a double belt comprising two parallel belts which are spaced apart from one another; thus enabling the stop means 18*k* to be guided through the input belt 62*k* in the area of the spacing. The stop means 18*k* are designed as drivers 30*k* and counter holders 32*k* which are rotatably mounted about one degree of freedom 38*k* that is perpendicular to the transportation movement 28*k* and are actuated via a link control 52*k*. As an alternative to the link control 52*k*, provision could, for example, also be made for a servomotorical actuation. In a first step, the counter holders 32*k* are inclined in the direction of the transportation movement 28*k* and move slower in said direction of the transportation movement 28*k* than the input belt 62*k*; thus enabling the products 16*k* of respectively one product group 14*k* delivered from the feed belt 58*k* onto the input belt 62*k* to be pushed against a counter holder 32*k* and to form shingled product arrangements 64*k*. A shingle angle 78*k* of the product groups 14*k* becomes increasingly steeper as a result of the difference in speed between the input belt 62*k* and the counter holder 32*k*. In a second step II, the holders 32*k* are placed perpendicularly to the transportation movement 28*k*, and the drivers are laid at the end of the respective product group 14*k* which is opposite to the transportation movement by means of a tilting operation. In a step III, the drivers 30*k* are arranged perpendicularly to the transportation movement 28*k* and thus the product stacks are formed by reducing a spacing 24*k* between stack contact surfaces 20*k* of the drivers 30*k* and the counter holders 32*k*, said stack contact surfaces lying opposite one another in a product group direction 26*k*. Drivers 30*k* and counter holders 32*k* now move synchronously in the direction of the transportation movement 28*k* in order to further transport the product stacks 12*k*.

What is claimed is:

1. A product stacking device for forming product stacks (12*a-k*) of product groups (14*a-k*) consisting of products (16*a-k*), each of which includes a primary face defined as the largest face of the product, the device comprising at least two stop means (18*a-k*) mounted on a common conveyor with stack contact surfaces (20*a-k*), which are configured to form a product stack (12*a-k*) on a product support surface of the common conveyor by a reduction of a spacing (24*a-k*) between the stack contact surfaces (20*a-k*), the stack contact surfaces lying opposite one another in a product group direction (26*a-k*), wherein at least one of the stop means is provided for spacing the product groups of the delivered products apart from one another, and wherein the device is 1) operable to form a product stack configured such that the primary faces of the products are oriented at 0 degrees relative to the product support surface and 2) operable to form a product stack configured such that the primary faces of the products are oriented at 90 degrees relative to the product support surface.

2. The product stacking device according to claim 1, wherein at least one of the at least two stop means (18*a-k*) is formed by at least one of a driver (30*a-k*) and a counter holder (32*a-e; g-k*).

3. The product stacking device according to claim 1, further including at least one bearing unit (36*a-c; f-j*) by means of which at least one of the at least two stop means (18*a-c; f-k*) is rotatably mounted about at least one degree of freedom (38*a-c; f-k*).

4. The product stacking device according to claim 3, further including at least one drive unit (46*a-h*) configured to drive the at least one of the at least two stop means (18*a-h*) in the at least one degree of freedom (38*a-c; f-h* and 44*a-h*).

5. The product stacking device according to claim 1, further including at least one bearing unit (40*a-h*) by means of which at least one of the at least two stop means (18*a-h*) is mounted in a translationally movable manner at least along a working section (42*a-h*) in at least one degree of freedom (44*a-h*).

6. The product stacking device according to claim 5, further including at least one drive unit (46*a-h*) configured to drive the at least one stop means (18*a-h*) in the at least one degree of freedom (38*a-c; f-h* and 44*a-h*).

7. The product stacking device according to claim 1, wherein at least one of the at least two stop means (18*e-f; h*) has stack contact surfaces (20*e-f; h*) on two sides (48*e-f; h* and 50*e-f; h*) lying opposite one another in the product group direction (26*e-f; h*).

8. The product stacking device according to claim 1, further including at least one linkage configured to move the stop means.

9. The product stacking device according to claim 1, further including at least one electrical and/or electronic control unit (54*b; d-h*) configured to control position and speed of the at least two stop means.

10. The product stacking device according to claim 1, wherein at least one of the at least two stop means is formed by a lateral guide placed at an angle in relation to the transportation movement.

11. The product stacking device according to claim 1, wherein an input belt (62*k*) is configured to push the product groups (14*k*) resting on the input belt (62*k*) with the transportation movement (28*k*) against stop means (18*k*) that are moving slower in relation to said transportation movement (28*k*).

12. A method for forming at least one horizontal or vertical product stack (12*a-k*) with a product stacking device (10*a-k*) according to claim 1, the method comprising forming the at least one product stack (12*a-k*) by reducing the spacing (24*a-k*) between the stack contact surfaces (20*a-k*) of the at least two stop means (18*a-k*), said stack contact surfaces lying opposite one another in the product group direction (26*a-k*).

13. A delivery device for delivering products (16*a-k*) to a packaging process, comprising a product stacking device (10*a-k*) according to claim 1.

14. A product stacking device for forming product stacks of product groups consisting of products, which lie flatly and/or are brought into a shingled product arrangement, during a transportation movement, comprising at least two stop means with stack contact surfaces, which are configured to form a product stack by a reduction of a spacing between the stack contact surfaces, the stack contact surfaces lying opposite one another in a product group direction, wherein at least one of the at least two stop means is formed by a lateral guide placed at an angle in relation to the transportation movement.

* * * * *